United States Patent [19]

Müller et al.

[11] 3,961,872

[45] June 8, 1976

[54] GEAR MACHINE WITH FLUID-BIASED END FACE SEALING ELEMENTS

[75] Inventors: Karl-Heinz Müller, Gerlingen; Wolfgang Talmon, Otisheim; Wilhelm Dworak, Stuttgart, all of Germany

[73] Assignee: Robert Bosch G.m.b.H., Stuttgart, Germany

[22] Filed: Dec. 17, 1974

[21] Appl. No.: 533,674

[30] Foreign Application Priority Data

Jan. 24, 1974 Germany ..... 2403319

[52] U.S. Cl. ..... 418/132

[51] Int. Cl.[2] ..... F01C 19/08; F03C 3/00; F04C 15/00

[58] Field of Search ..... 418/131, 132

[56] References Cited

UNITED STATES PATENTS

| | | | |
|---|---|---|---|
| 2,695,566 | 11/1954 | Compton | 418/132 |
| 2,932,254 | 4/1960 | Booth et al. | 418/132 |
| 3,050,010 | 8/1962 | Thrap et al. | 418/132 |
| 3,137,238 | 6/1964 | Gordon | 418/132 |
| 3,348,492 | 10/1967 | Olson et al. | 418/131 |
| 3,395,646 | 8/1968 | Gelin | 418/133 |
| 3,473,474 | 10/1969 | Martinaglia | 418/132 |
| 3,499,390 | 3/1970 | Prijatel | 418/132 |

*Primary Examiner*—John J. Vrablik
*Attorney, Agent, or Firm*—Michael J. Striker

[57] ABSTRACT

A hydraulic gear machine which may be utilized as a pump or motor has a housing forming a cavity in which a pair of gears having meshing teeth is mounted for rotation. Sealing elements are interposed between the axial ends of the gears and the bearings mounting the gears for rotation; these sealing elements have first surfaces which face the gears and second surfaces facing the bearings and being formed with recesses which form fluid-pressure spaces. At least one seal member is provided adjacent the respective second surfaces and serves to delimit the respective recess. Each seal member has one sealing face which engages an inner circumferential wall of the housing and another sealing face which engages an outer surface of one of the associated sealing element and bearing, which outer surface extends circumferentially of the axis of rotation of the gears.

19 Claims, 11 Drawing Figures

GEAR MACHINE WITH FLUID-BIASED END FACE SEALING ELEMENTS

BACKGROUND OF THE INVENTION

This invention relates in general to a hydraulic machine, and more particularly to a rotary hydraulic gear machine which may be utilized as a pump or motor and has two revolving gears provided with meshing teeth.

It is known to provide machines of this general type with bearings which journal the gears for rotation, and to provide sealing elements that are interposed between the axial ends of the gears and the associated bearings and are pressed against the axial ends of the gears by fluid pressure that develops in operation between the sealing elements and the bearings that are adjacent to them. However, in this type of machine the pressure fluid will flow in the space between the bearings and the housing wall of the machine and finally leads to the development of fluid pressure fields between the bearings and the housing end cover. These fields, however, have no useful purpose, and in particular do not contribute to balancing any of the forces within the gear machine; they merely exert stresses upon the housing, the housing end cover and the screws or other devices which connect the housing and the end cover so that these components must be manufactured more strongly than would inherently be dictated by their function if it were not for these pressure fields. This means that the machine is not only more expensive, since more material is required than would otherwise be necessary, but also will have a greater weight and larger dimensions.

SUMMARY OF THE INVENTION

Accordingly, it is a general object of this invention to overcome the disadvantages of the prior art.

More particularly, it is an object of this invention to provide an improved hydraulic gear machine which is suitable for use as a gear pump or motor, wherein the aforementioned disadvantages are avoided.

Still more particularly, it is an object of the invention to provide such an improved hydraulic gear machine wherein the fluid pressure fields are limited to the size required for providing force compensation within the machine, and wherein the stresses exerted by such fields upon the housing, the cover or covers and connecting devices are particularly, low.

In keeping with these objects, and with others which will become apparent hereafter, one feature of the invention resides, in a hydraulic gear machine, particularly a gear pump or motor, in a combination which, briefly stated, comprises a housing forming a cavity, a pair of gears in the cavity having meshing teeth, and bearing means mounting the gears for rotation. Sealing elements are interposed between the bearing means and respective end faces of the gear; these sealing elements have first surfaces facing the end faces and second surfaces facing the bearing means and formed with recesses which form fluid-pressure spaces. At least one annular seal member is located adjacent each of the second surfaces and delimits the respective recess. Each seal member has one sealing face which engages an inner circumferential wall of the housing and another sealing face which engages an outer surface of one of the associated sealing element and bearing means, which outer surface extends circumferentially of the axes of rotation of the gears.

In this construction of the present invention the flow of leakage fluid which causes pressure fields to develop is limited strictly to those spaces where it is intended that such fields should develop, and is prevented to areas where no such fields are desired. This eliminates the aforementioned disadvantages of the prior art.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
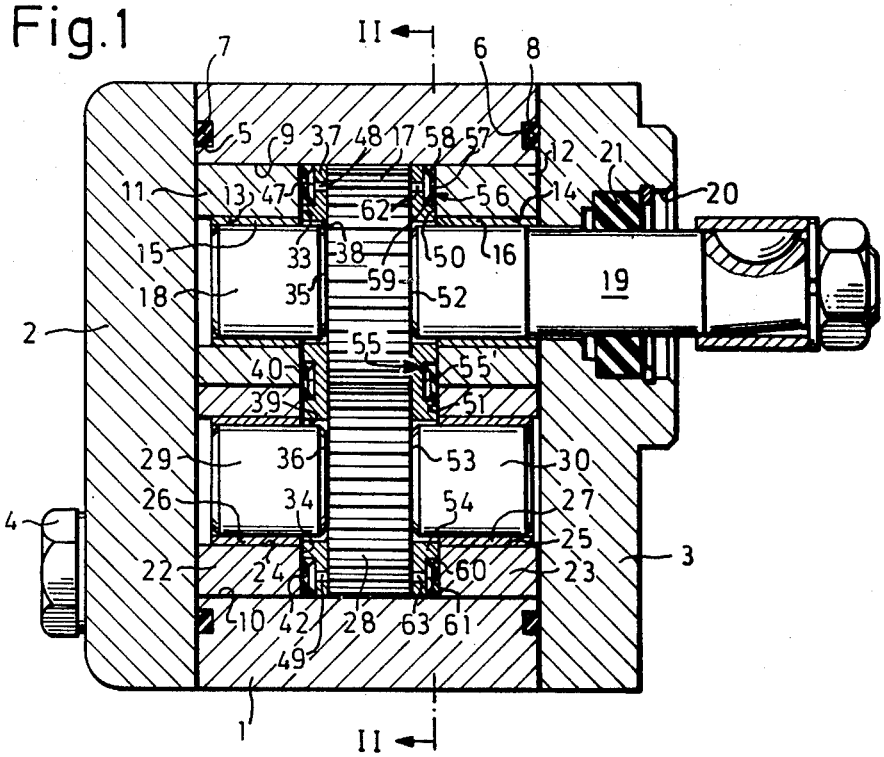
FIG. 1 is an axial section through a hydraulic gear machine according to one embodiment of the invention.
Figure 2:
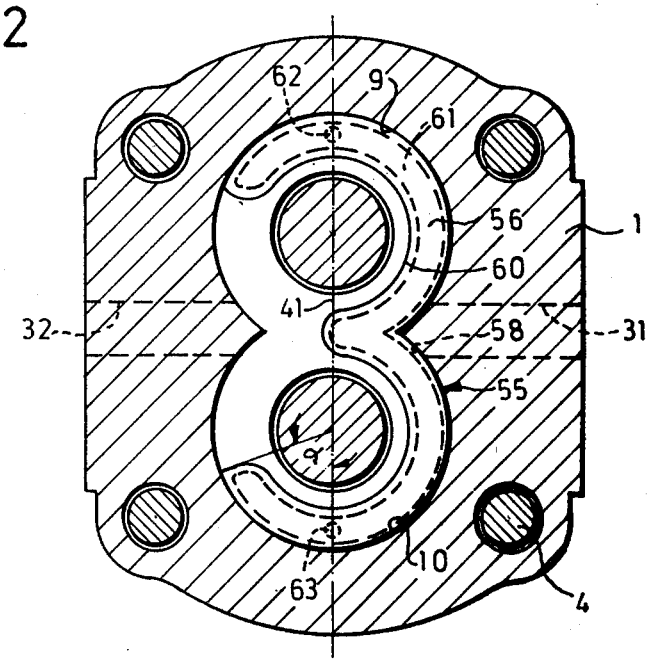
FIG. 2 is a cross section taken on line II—II of FIG. 1.
Figure 3:
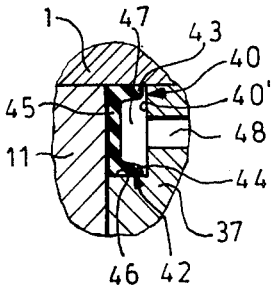
FIG. 3 is a fragmentary sectioned detail view, showing a detail of the machine in FIGS. 1 and 2 on an enlarged scale.

Referring firstly to the embodiment in FIGS. 1–3 it will be seen that the hydraulic gear machine illustrated therein has a housing 1 which is formed with an interior cavity constituted by two axially parallel overlapping bores 9, 10, so that the cavity has a cross-sectional configuration resembling a numeral 8. The opposite axial ends of the cavity are closed by end covers 2 and 3 which are mounted on the housing 1 by means of appropriate screws 4 or similar connecting devices. At each axial end of the housing 1 there is formed a circumferentially complete groove 5, 6 of approximately oval outline in each of which there is located a similarly circumferentially complete sealing member 7, 8 which engages the respective end cover 2, 3 and seals the interior of the housing with respect to its exterior.

A pair of sleeve bearings 11, 12 is arranged in the bore 9, having respective center passages 13, 14 each of which has a bushing 15, 16 press-fitted within it. A gear 17 has a stub shaft 18 which is journalled for rotation in the bushing 15, and a further shaft 19 which is journalled in the bushing 16 and serves as a drive shaft. For this purpose the shaft 19 extends through a stepped bore 20 formed in the end cover 3 to the exterior of the housing 1; the bore 20 accommodates a shaft seal 21 which seals the interior of the housing.

A pair of further sleeve bearings 22, 23 is mounted in the bore 10; these correspond completely to the bearing sleeves 11, 12 and are each also provided with a central passage 24, 25 into which a respective bushing 26, 27 is press-fitted. A second gear 28 is provided, having teeth which mesh with the teeth of the gear 17 and being formed with a pair of stub shafts 29, 30 which are journalled for rotation in the bushings 26 and 27, respectively.

As FIG. 2 shows clearly, the housing 1 is formed with a bore 31 which is located at the high-pressure side and through which fluid at high pressure is admitted into the housing 1 when the machine operates as a motor, whereas fluid under high pressure exits through the bore 31 when the machine operates as a pump. A second bore 32, coaxial with the bore 31, is also formed in the housing 1 and is located at the low-pressure side of the machine. When the machine operates as a fluid motor the low pressure fluid flows out through the bore 32, whereas the fluid is supplied to the housing 1 via the bore 32 at low pressure if the machine operates as a pump. The bores 31 and 32 are located substantially midway between the axes of rotation of the gears 17 and 28.

A sealing element 37 is located between end faces 33 and 34 of the sleeve bearings 11 and 22 on the one hand and end faces 35 and 36 of the gears 17 and 28 on the other hand. The outline of the sealing element 37 corresponds to the cross-sectional configuration of the cavity formed by the bores 9 and 10, as seen in FIG. 2. The sealing element 37 is provided with two openings 38 and 39 through which the stub shafts 18 and 29 extend; additionally, it is formed at its axial end that faces away from the gears 17 and 28 with a recess 40 which extends to the outer circumference of the sealing element 37 from the center of an imaginary line 41 which connects the axes of rotation of the gears 17, 28; this recess 40 extends in the circumferential direction of the sealing element 37 from the high-pressure side of the direction towards the low-pressure side of the machine. As shown in FIG. 2, an imaginary line touching one or the other end of the recess 40 and passing through the axis of rotation of the gear closest to the particular end, includes with the imaginary line 41 an angle $\alpha$ of approximately 60°.

A seal member 42 is accommodated in the recess 40. The cross section of the seal member 42 is shown on an enlarged scale in FIG. 3 from which it is evident that this cross-section is substantially U-shaped by virtue of the fact that the seal member 42 has two arms 43, 44 and a bight 45 which connects the arms 43, 44. The seal member 42 is so arranged in the recess 40 that its bight 45 engages the end faces 33, 34 of the bearing sleeves 41 and 22, respectively, whereas the arm 43 engages the inner circumference of the cavity in the housing and the arm 44 engages a shoulder of the recess 40 which extends parallel to this inner circumference. FIG. 3 also shows that the arms 43, 44 are slightly shorter than the length of the shoulder 46 so that they extend towards but not into engagement with an end face 40° which in part bounds the recess 40 and which extends parallel to the end faces 35, 36 of the gears 17, 28. The seal member 32 and the sealing element 37 thus together surrounds and form a fluid-pressure space 47 whose shape resembles the outline of a numeral 3.

The sealing element 37 is formed with a bore 48 which communicates with the space 47 and is located on the imaginary line 41. The bore 48 extends from the region of that side of the sealing element 37 which faces towards the gear 17 and past which those gaps between the teeth of the gear 17 travel in operation of the machine which contain fluid at high pressure. A second bore 49 is also formed in the sealing element 37 and located on the imaginary line 41, extending from that region of the sealing element 37 over which again the gaps in the teeth of the gear 28 pass which are at high-pressure; this bore 49 also communicates with the fluid pressure space 47 so that by virtue of this communication of the two bores 48 and 49 the space 47 will always contain fluid at high pressure.

The machine has a second sealing element 54 which corresponds to the sealing element 37 and is arranged in the same manner as the sealing element 37, but between end faces 50, 51 of the sleeve bearings 12, 23 and end faces 52, 53 of the gears 17, 28. This sealing element 54 is formed with a recess 55 that corresponds to the recess 40 and which accommodates a seal member 56 that corresponds in all details to the seal member 42. The seal member 46 has a bight 57 which engages the end faces 50, 51 of the bearing sleeves 12, 23; it further has one arm 58 which engages the inner circumference of the cavity formed in the housing 1 and another arm 59 which engages a shoulder 60 of the recess 55 whose end face is designated with reference numeral 55′. The sealing element 54 and the seal member 56 thus surround and define a pressure space 61 which again has the outline of a numeral 3 and which communicates via a bore 62 that is coaxial to the bore 48, with the high-pressure gaps in the teeth of the gear 17, and via a further bore 63 that is coaxial with the bore 49, with the high-pressure gaps between the teeth of the gear 28. Thus, the fluid-pressure space 61 is also at high pressure during operation of the gear machine.

If the machine is operated as a motor and fluid at high pressure is supplied via the bore 31, then the fluid enters into the spaces between the teeth on the gears and is expelled from these spaces where the teeth of the other gear enters the respective spaces, so that it flows out through the bore 32. In addition, the high-pressure fluid travels from these spaces between the teeth of the gears 17, 28 via the bores 48 and 49 into the pressure space 47. The pressure of the fluid forces the arms 43 and 44 into tight sealing engagement with the inner circumferential surface of the cavity in the housing 1 and with the shoulder 46, respectively, so that any travel of pressure fluid in axial direction in the gap between the sleeves 11 and 22 and the walls of the bores 9 and 10, or along the shoulder 46, is precluded. In a similar manner, pressure fluid travels from the spaces between the teeth of the gears 17, 28 via the bores 62 and 63 into the space 61, forcing the arms 58 and 59 of the seal member 56 into the tight sealing engagement against the inner circumferential wall bounding the cavity in the housing 1 and against the shouder 60, respectively. The effect here is the same as with respect to the seal member 42.

Moreover, the wall in the interior of the housing is subjected in axial direction of the housing to high stresses only in the region between the arm 43 of the seal member 42 and the arm 58 of the seal member 56. This reduces the transmission of stresses to the housing to a minimum. In radial direction the pressure fields which develop can act only in the region of the end face 40' of the recess 40, that is they are held to the smallest possible dimension. The pressure exerted by the pressure fluid upon the sealing element 37 is over compensated by the pressure exerted from the space 47 upon the end face 40' of the recess 40, to such an extent that the sealing element 37 tightly engages the end faces 35, 36 of the gears 17, 28, thus assuring that leakage losses are small. The end face 40' and the angle $\alpha$ will of course have to be appropriately dimensioned. The above comments are analogously applicable with respect to the recess 55 and the operation of the seal member 56. Since the arms of the seal members are sufficiently elastic so that under the pressure of the pressure fluid they are deflected into tight sealing engagement with the cooperating surfaces, the length of the arms can be less than the length of the associated shoulder, so that compressing of the respective seal members and sealing elements in axial direction is not necessary.

The construction and arrangement of the seal members and sealing elements assures that the surfaces subject to high-pressure fluid have the smallest possible dimensions, which means that the stresses are correspondingly small and therefore the dimensions of the housing wall and the thickness of the end covers 2, 3 as well as the dimensioning of the screws 4 can be made correspondingly small; conversely, if these dimensions are not reduced, then the machine will have a correspondingly greater capacity. In connection with the sealing effect obtained by the seal members and their elasticity and the manner in which they are pressed into engagement with the cooperating surfaces by the pressure of the fluid, it has been found that greater tolerance variations than heretofore are permissible for the bearing sleeves. The reduced wear of the sealing elements increases the lifetime and the reliability of the machine significantly.

The members 42, 56 could also be so installed in the recesses 40, 55 that their respective bights 45, 57 would engage the end faces 40', 50', respectively. In this case, however, the length of the arms 43, 44, 58 and 59 would have to be so great that after installation they would sealingly engage the end faces of the bearing sleeves 11, 12, 22, 23, in order to prevent high-pressure fluid from traveling in the gap between the bearing sleeves and the wall in the housing cavity, in axial direction.

Figure 4:
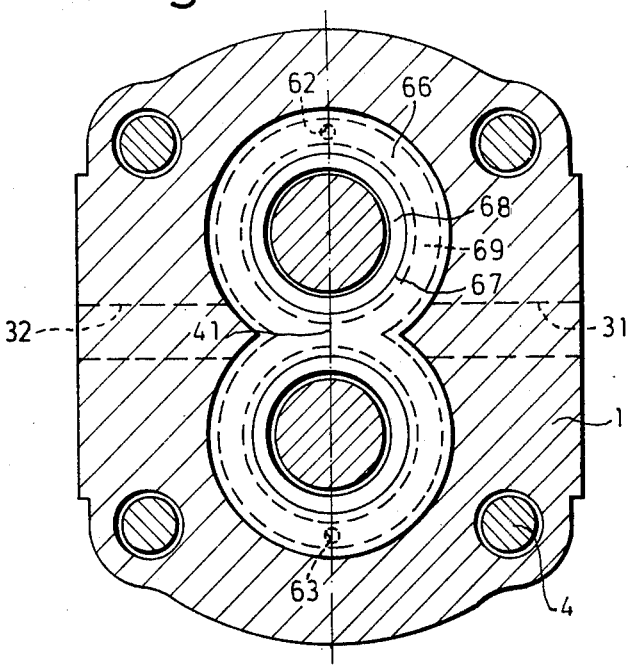
FIG. 4 is a view similar to FIG. 2, but illustrating a further embodiment of the invention.

FIG. 4 shows a reversible hydraulic gear machine which can be used as a pump or a motor, and wherein like components as in FIGS. 1–3 are identified with like reference numerals.

In this machine a seal member 66 is provided, corresponding to one of the seal members 42 or 56 but having the outline of a numeral 8, rather than that of a numeral 3. It does, however, have the same U-shaped cross-sectional configuration as described with respect to the seal members 42 and 56. The seal member 66 is received in a recess 67 of a sealing element 68 and forms therewith a fluid pressure space 69 which of course also has the form of a numeral 8 and is arranged symmetrically with reference to the line 41 connecting the axis of rotation of the gears 17 and 28. The end face bounding the space 69 in the direction towards the end faces of the gears is again so dimensioned that the forces exerted by the fluid in the gaps between the teeth of the gears upon the seal member 68 are compensated-for and that beyond this there will be exerted (by the fluid in the space 69) a sufficient force to press the sealing element 68 against the adjacent end faces of the gears.

The symmetrical arrangement of the fluid pressure space 69 with reference to the line 41 makes it possible to utilize the gear machine of FIG. 4 in a reversible mode, that is its direction of rotation can be reversed when it acts as a motor or its pumping direction can be reversed when it acts as a pump. The force equilibrium obtained is independent of the mode of operation. The manner in which the seal member 66 (of which there are of course two present just as in the preceding embodiment) operates corresponds to the manner in which the seal members 42, 56 operate in FIG. 1–3.

Figure 5:
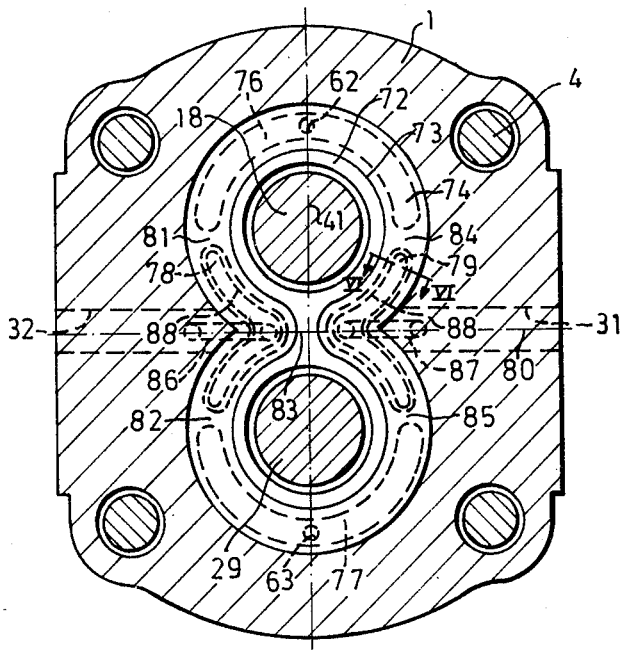
FIG. 5 is a view similar to FIG. 4, illustrating still a further embodiment of the invention.
Figure 6:
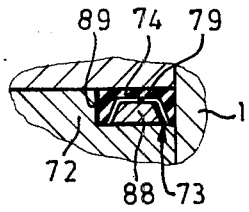
FIG. 6 is a fragmentary sectioned view, illustrating a detail of the embodiment in FIG. 5 on an enlarged scale.

FIGS. 5 and 6 show still a further embodiment of the invention, again embodied in a reversible hydraulic gear machine. The components which are the same as in the preceding embodiments are again identified with like reference numerals.

In FIGS. 5 and 6 there are provided two sealing elements 72 located at the opposite axial ends of the gears, each having an outline corresponding to that of a numeral 8. At the axial end of the respective sealing element 72 there is formed a recess 73 extending to the outer circumference at the side remote from the respective gears and which also has the form of a numeral 8 and accommodates a seal member 74 of similar shape. The seal member 74 is of U-shaped crosssection and surrounds with the surface of the recess 73 which extends parallel to the axial ends of the gears a fluid pressure space which is composed of a plurality of separate compartments or sections. This fluid pressure space has two semi-circular compartments 76, 77 each of which is arranged symmetrically with reference to the line 41 in the circumferential region of the respective stub shafts 18, 29 which faces away from the respectively other stub shaft 29, 18. In addition, the fluid pressure space also has two substantially V-shaped compartments 78, 79 which are arranged symmetrically with reference to a line 80 which extends normal to the line 41 substantially midway between the axes of rotation of the two gears. The bores 31 and 32 are located on the line 80. The compartment 78 is located at the side of the bore 32 and the compartment 79 at the side of the bore 31. Each of the compartments 78, 79 has two arcuate portions each of which extends over less than a quarter of a circle and which are located on the same circle as the compartments 76 and 77, respectively. The compartment 78 is separated by a land 81 from the compartment 76, and by a land 82 from the compartment 77 and by a land 83 located on the line 41 from the compartment 79. The compartment 79 is separated from the compartment 76 by a land 84 and from the compartment 77 by a land 85. The lands are formed on the seal itself.

A bore 62 communicates with the compartment 76, a bore 63 communicates with the compartment 77, and both of these communicate the respective compartments with the gaps between the teeth of the gears which are at high-pressure. A channel 86 extends from the bore 83 and communicates with the compartment 78 so that the latter is at the same pressure as the bore 32. A similar channel 87 extends from the bore 31 into the compartment 79 to obtain a pressure equilization between them. The bores 31 and 32 each may either be the low-pressure bore, or the high-pressure bore, depending upon the mode of operation. A pair of supporting bodies 88 is received in the compartments 78 and 79, having the same shape as those but being of somewhat smaller dimensions.

Due to the arrangement of the compartments 76-79 chosen for the embodiment in FIGS. 5 and 6, the hydraulic gear machine in these figures can be reversibly operated in either mode, that is either when it operates as a pump or as a motor. The compartments 78 and 79 are so configurated that, when low pressure exists at the outlet side (when the machine operates as a motor) or at the inlet side (when the machine operates as a pump) the pressure exerted upon that surface which faces the gear end face in the respective pressure space will just compensate for the force which additionally is exerted in this operational mode upon the sealing element by the fluid in the gaps between the teeth of the gears. This compensation is independent of the value of the counterpressure. The lands 81, 82, 84 and 85 prevent a flow of fluid from the compartments 76 and 77 which are always at high-pressure, to the low-pressure compartments 78, 79. The supporting bodies or members 88 are located in the compartments 78, 79 to prevent the lands 81–85 from being destroyed by the pressure of the pressure fluid. The land 83 located between the compartments 78, 79 serves the same function as the previously described lands 81, 82 and 84, 85.

The seal member 75 is higher than a shoulder 89 of the recess 73, so that in the installed condition the seal member is axially compressed, that is compressed in axial direction of the gears. This assures that the sealing member 75 will be in sealing contact with the cooperating surface of the recess 73 everywhere, including the region of the lands 81–85.

It will be appreciated that in all embodiments the invention can also be realized if the bearings for the shafts of the gears are not in form of separate sleeve bearings, but are constructed as united (at each end the gears) bearings, for example in form of bearing members having the shape of a numeral 8. It will also be possible to make the sealing elements, such as the sealing elements 37 and 54 of FIGS. 1–3, of two parts instead of one part, each being associated with the bearing at one end of a respective gear, that is the sealing element 37 could be thus made of two parts, and so could be the sealing element 54 or any of the other sealing elements in the other embodiments.

Figure 7:
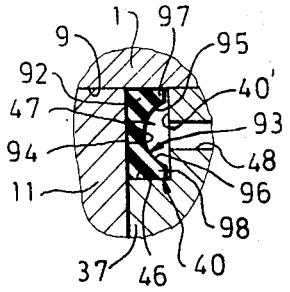
FIG. 7 is a view similar to FIG. 3, illustrating a cross-sectional detail of a seal member suitable for use with any of the proceeding embodiments.

FIGS. 7–11 show other cross-sectional configurations that may be chosen for the seal members of the illustrated embodiments of the machine. Thus, FIG. 7 shows an embodiment wherein the seal member 92 has a substantially U-shaped cross section which is obtained by forming the seal member with a rectangular cross-section and forming one of the longer sides of the rectangle with a substantially arcuate recess 93 in which the radius of the center section 94 merges into a smaller recess at the sides 95 and 96. The seal member 92 is thus formed with two sealing lips 97 and 98 which, when pressure exists in the pressure space 47, are pressed against the wall bounding the cavity in the housing 1 and the shoulder 46 of the recess 40, respectively. The sealing effect of the embodiment of FIG. 7 is the same as that described with respect to the seal member 42 of FIGS. 1–3.

Figure 8:
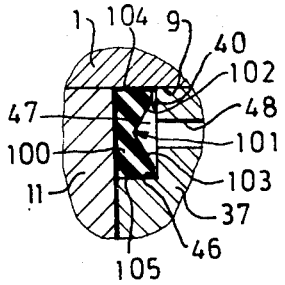
FIG. 8 is a view similar to FIG. 7, illustrating a different cross section of a further seal member.

FIG. 8 shows a seal member 100 having a substantially double-trapezoidal cross-section. The cross section of the seal member 100 is inherently rectangular and the rectangle is formed in one long side with a triangular recess 101. There are thus obtained two surfaces 102, 103 which include with one another an obtuse angle and upon which the pressure in the space 47 acts. The seal member 100 engages with its narrow sides 104, 105 the shoulder 46 and the wall bounding the housing cavity, respectively, under the influence of the fluid pressure component that acts in the direction of the sides 104, 105 under the influence of the fluid pressure which bears against the surfaces 102, 103. The sealing effect is again the same as described with respect to FIGS. 1–3.

Figure 9:
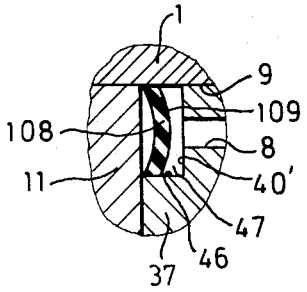
FIG. 9 is a view similar to FIG. 8, illustrating the cross-section of still another seal member.

In FIG. 9 there is illustrated a seal member 108 whose cross-section resembles a section of a circle, so that the seal member 108 has a convex side 109 which faces the pressure space 47. The pressure in the space 47 attempts to force the seal member 108 against the bearing sleeve 11 so that the narrow sides of the seal member 108 are pressed into sealing relationship with the wall of the housing bounding the cavity and the shoulder 46, respectively. The sealing effect again is the same as described with respect to FIGS. 1–3.

Figure 10:
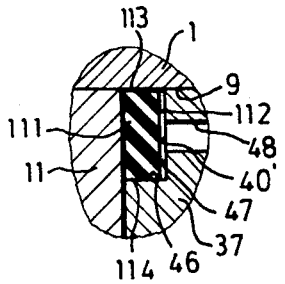
FIG. 10 is a view similar to FIG. 9 illustrating the cross-section of a further seal member.

FIG. 10 illustrates a seal member 111 which is of rectangular cross-section and wherein one long side of the rectangle is identified with reference numeral 112 and faces inwardly of the fluid pressure space 47. This side 112 is therefore subjected to the pressure in the space 47 and tends to compress the seal member 111 in its thickness, whereas simultaneously the length (i.e. the length of the long side 112) increases concomitantly so that the narrow sides 113 and 114 of the rectangle are firmly pressed in sealing relationship against the housing wall bounding the cavity and against the shoulder 46, respectively. Such a seal member can be produced particularly simply and inexpensively and has been found to be very effective.

Figure 11:
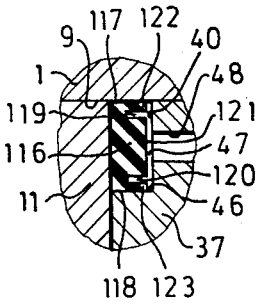
FIG. 11 is a view similar to FIG. 10, illustrating the cross-section of yet an additional seal member which, as the seal members of FIGS. 7–10, can be used in any one of the embodiments of FIG. 1–5.

Finally, FIG. 11 illustrates a seal member 116 which is a modification of the one shown in FIG. 10 and which is also of rectangular cross section. The narrow sides 117 and 118 of the rectangle engage the inner circumferential wall of the housing that bounds the cavity and the shoulder 46, respectiveely, whereas the long sides face inwardly and outwardly of the space 47, respectively. The long side 121 faces inwardly of the space 47 and the seal member 116 is formed with a pair of slot-shaped recesses 119, 120 which extend inwardly from the long side 121 adjacent and parallel to the narrow sides 117, 118, respectively. Thus, the narrow sides are provided with sealing lips 122, 123 which are pressed outwardly into sealing engagement with the wall bounding the cavity and with the shoulder 46, respectively, as pressure fluid from the space 47 and as the slot-shaped recesses 119, 120 and effects such outward deflection of these sealing lips 122, 123. The operation and sealing effectiveness of this embodiment again is essentially the same as described with respect to FIGS. 1–3.

It will thus be seen that the present invention overcomes the disadvantages of the prior art and makes it possible to construct a hydraulic gear machine wherein the fluid pressure fields are precisely defined and delimited so that they will act only in the intended manner and will not cause the problems which have been found to be disadvantageous in the prior-art constructions.

It will be understood that each of the elements described above, or two or more together, may also find a useful application in other types of constructions differing from the types described above.

While the invention has been illustrated and described as embodied in a hydraulic gear machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a hydraulic gear machine, particularly a gear pump or motor, a combination comprising a housing having an inner surface bounding a cavity; a pair of gears in said cavity and having meshing teeth; means for mounting said gears for rotation about spaced axes and including bearing elements; sealing elements interposed between said bearing elements and said gears, said bearing elements being juxtaposed with said housing and said sealing elements along respective interfaces and defining with said housing and said sealing elements respective recesses into which said interfaces open; and seal member accommodated in said recesses and delimiting therein confined spaces for a pressurized fluid, each of said seal members having one sealing face which engages said inner surface of said housing and another sealing face which engages a circumferential surface radially inwardly bounding said recess and being operative for interrupting communication between said confined spaces and said interfaces to thereby prevent the pressurized fluid from reaching and leaking through said interfaces.

2. A combination as defined in claim 1, wherein said sealing elements are formed with openings communicating said confined spaces with peripheral regions of said gears to thereby admit the pressurized fluid into said confined spaces, the pressurized fluid urging said sealing faces into engagement with said inner surface of said housing and said circumferential surface, respectively.

3. A combination as defined in claim 1, wherein said spaces are each substantially surrounded by one of said seal members and a surface portion of the associated sealing element which is axially recessed from the respective interface, said seal members each extending towards and into engagement with said surface portion.

4. A combination as defined in claim 1, wherein said spaces are each substantially surrounded by one of said seal members and a surface portion of the associated sealing element which extends normal to the axes of said gears.

5. A combination as defined in claim 1, said gear machine having a high-pressure side and a low-pressure side; and wherein each of said spaces has a shape resembling the numeral 3 and composed of two arcuate sections which arc outwardly from a plane encompassing the axes of rotation of said gears, and which extend from said high-pressure side towards said low-pressure side.

6. A combination as defined in claim 1, wherein each of said spaces has a shape resembling the numeral 8 and is arranged symmetrically relative to a first plane encompassing the axes of rotation of said gears as well as to a second plane bisecting said first plane normal thereto midway between said axes of rotation.

7. A combination as defined in claim 1, said spaces each being subjected to a fluid pressure which is at least equal to the pressure of fluid which flows from between the meshing teeth of said gears and acts upon said sealing elements.

8. A combination as defined in claim 1, wherein the radial dimensions of said spaces corresponds substantially to the height of said teeth, and said teeth are located in the radial region of said spaces.

9. A combination as defined in claim 1, wherein each seal member has a U-shaped cross-section and includes a pair of substantially trapezoidal arms which have said sealing faces and a bight portion of substantially constant thickness which connects said arms.

10. A combination as defined in claim 1, wherein each seal member has a rectangular cross-section and is formed with an arcuate recess extending inwardly from a long side of the rectangular cross-section.

11. A combination as defined in claim 1, wherein each seal member has a rectangular cross-section and is formed with a triangular recess that extends inwardly from a long side of the rectangular cross-section.

12. A combination as defined in claim 1, wherein each seal member has an arcuate cross-section resembling a section of a circle and having a convex side which faces the associated space.

13. A combination as defined in claim 1, wherein each seal member has a rectangular cross-section one long side of which faces the associated space.

14. A combination as defined in claim 1, wherein each seal member has a rectangular cross-section, said sealing faces being provided on the narrow sides of said rectangular cross-section, each seal member further having a pair of slot-shaped recesses each extending inwardly from that one of the longer sides which faces the respective space parallel and adjacent to one of said narrow sides over a substantial portion of the length of the respective narrow side.

15. A combination as defined in claim 1, wherein each of said spaces is composed of two semi-circular first compartments each arranged symmetrically with reference to a line connecting the axes of rotation of said gears and located at a circumferential side of the respective axis which is remote from the other axis, and a pair of substantially V-shaped compartments which are arranged symmetrically with reference to a plane bisecting said line normal thereto midway between said axes, one of said V-shaped compartments communicating with a fluid inlet port of said machine and the other V-shaped compartment communicating with a fluid outlet port of said machine.

16. A combination as defined in claim 15, wherein each of said V-shaped compartments includes two arcuate portions extending from the region of said line circumferentially of the respective axis and to said semi-circular compartments, all of said compartments being separated by sealing lands, said semi-circular compartments being subjected to high-pressure and said V-shaped compartments being subjected to the pressure of the respective port with which they communicate.

17. A combination as defined in claim 16, wherein said semi-circular compartment and said arcuate portions are located on circles of identical diameters.

18. A combination as defined in claim 16, and further comprising supporting members received in said V-shaped compartments and having the same shape, but smaller dimensions than the same.

19. A combination as defined in claim 10, wherein said spaces are each substantially surrounded by one of said seal members and a surface portion of the associated sealing element which is axially recessed from the respective interface, said seal members each extending towards but terminating short of said surface portion.

* * * * *